United States Patent [19]

Bouchard et al.

[11] Patent Number: 4,836,816

[45] Date of Patent: Jun. 6, 1989

[54] METHOD OF TREATING TUNGSTEN CATHODES

[75] Inventors: Andre C. Bouchard, Peabody; Paul A. Thibault, Danvers, both of Mass.

[73] Assignee: GTE Products Corporation, Danvers, Mass.

[21] Appl. No.: 191,104

[22] Filed: May 6, 1988

[51] Int. Cl.[4] ..... H01J 9/04

[52] U.S. Cl. ..... 445/51; 445/58; 427/77; 313/346 R

[58] Field of Search ..... 445/58, 46, 51; 427/77; 313/346 DC, 346 R

[56] References Cited

U.S. PATENT DOCUMENTS

| | | | |
|---|---|---|---|
| 1,921,066 | 8/1933 | Bedford . | |
| 2,657,325 | 10/1953 | Homer et al. . | |
| 2,683,837 | 7/1954 | Hager | 427/77 X |
| 2,806,970 | 9/1957 | Meister et al. | 313/346 R X |
| 2,985,548 | 5/1961 | Blickweldel et al. | 427/77 |
| 3,249,788 | 5/1966 | Wainio et al. | 313/346 R |
| 3,536,526 | 10/1970 | Month | 427/77 |
| 3,837,909 | 9/1974 | Menelly . | |
| 3,969,279 | 7/1976 | Kern . | |

OTHER PUBLICATIONS

Kohl, *Materials and Techniques for Electron Tubes*, Reinhold Publishing Corp., New York, N.Y., (1960), pp. 551–558.

*Primary Examiner*—Kenneth J. Ramsey
*Attorney, Agent, or Firm*—Carlo S. Bessone

[57] ABSTRACT

A method of treating a tungsten cathode that is comprised of coating the surface of the tungsten cathode with a triple carbonate suspension. The coated tungsten cathode is placed in a heated oxidizing environment (e.g., air, oxygen, or carbon dioxide) and heated for a sufficient amount of time in order to form a diffuse coating of triple carbonates and tungsten oxide. Thereafter, the triple carbonates are reduced to their respective oxides by passing heater current through the tungsten cathode. When used in conjunction with the manufacture of a fluorescent lamp, the formation of this diffuse coating of carbonates enhances the chances of forming barium tungstate during the cathode activation process. As a result, the life of the fluorescent lamp is increased and the amount of phosphor darkening is reduced.

20 Claims, 3 Drawing Sheets

METHOD OF TREATING TUNGSTEN CATHODES

TECHNICAL FIELD

The instant invention relates in general to fluorescent lamps (e.g., glow lamps) and pertain, more particularly, to a method of treating coated coil emissive electrodes to increase the life of these lamps.

BACKGROUND OF THE INVENTION

A glow lamp typically is comprised of a light transmitting envelope containing a noble gas and mercury with a phosphor coating on an inner surface of the envelope which is adapted to admit visible light upon absorption of ultraviolet radiation that occurs when the lamp is excited. The lamp is excited by means of the application of a voltage between the lamp electrodes. Current flows between the electrodes after a certain potential is applied to the electrodes, commonly referred to as the breakdown voltage. An elementary explanation of the phenomenon is that the gas between the electrodes becomes ionized at a certain voltage, conducts current, and emits ultraviolet radiation. Examples of typical glow discharge lamps are found in U.S. Pat. Nos. 2,067,129 to Marden; 3,814,971 to Bhattacharya; and 4,408,141 to Byszewski et al.

Emissive electrodes are utilized in fluorescent lamps to supply free electrons, thereby enabling current flow in the fluorescent tube and have, therefore, been referred to as cathodes.

The cathodes normally comprise one or more of the alkaline earth metals and compounds thereof, as these materials have relatively low work functions and are therefore able to supply free electrons without requiring the expenditure of great amounts of energy. The provisions of these free electrons by the emissive alkaline earth materials consume the electrode material and when the material is depleted to the point where it can no longer supply sufficient electrons for lamp operation upon the application of standard fluorescent lamp voltages, the lamp will fail and will have to be discarded.

Cathodes of the type well known in the art are normally made by painting, dipping or otherwise adhering a co-precipitated triple carbonate suspension, usually comprising strontium carbonate, calcium carbonate, and barium carbonate to a coil tungsten wire. The emissive materials are adhered to the coil substrate by temporary adhesive binders such as cellulose nitrate. During the activation or breakdown process, the binder is removed by thermal decomposition and the cathode is subsequently heated to a sufficiently high temperature to decompose the carbonates to their respective oxides. Typically, about 6 milligrams (for a 40-watt coil) to 30 milligrams (for a VHO coil) of the electron emissive material is coated onto the surface of the tungsten filament. It is well known in the art that during cathode activation and lamp operation, excess barium can diffuse through the emissive coating mass and subsequently evaporate from the coating surface. This evaporation of barium not only results in a darkening of the adjacent phosphor coating causing a depreciation of the light output of the lamp, but also results in a reduced lamp life owing to the depletion of barium necessary for the thermionic emission of electrons. The quantity of this commonly used electron emissive alkaline earth material is limited by the aforementioned tungsten coil.

Many attempts have been made in an effort to prevent these undesirable effects in fluorescent lamps. For example, U.S. Pat. No. 2,657,325, which issued to Homer et al on Oct. 27, 1953, teaches the provision of a monomolecular layer of tungsten oxide at the interface between the tungsten and the alkaline earth oxide. The monomolecular layer is applied by directly oxidizing the tungsten before applying the carbonate coating. The lamp is thereafter exhausted rapidly under vacuum while the alkaline earth carbonates are broken down to the alkaline earth oxides by heating. The heating is done rapidly so as to prevent any further oxidation of the metal by the carbon dioxide given off. Alternatively, the wire can be initially free from appreciable oxidation, and can be oxidized by allowing the carbon dioxide produced during breakdown of the carbonates, to oxidize the tungsten or other metal sufficiently, and be itself reduced.

U.S. Pat. No. 3,837,909, which issued to Menelly on Sept. 24, 1974, teaches a method of increasing the life of a fluorescent lamp by embodying substantially more emissive material than coated coil electrodes commonly known in the art. In the Menelly patent, an inert gas (non-oxidizing), such as, argon at a temperature of approximately 500 degrees Celsius is directed toward the coil after being coated with a plastic-like coating of barium peroxide and cellulose nitrate. When the temperature of the coil and plastic-like coating reaches a temperature of approximately 400 degrees to 500 degrees Celsius, the barium peroxide begins to melt and flow over the tungsten coil substrate. As the temperature of the coil and coating increases to approximately 500 degrees Celsius, the cellulose nitrate binder reacts exothermally, decomposing into gases, the majority gas being nitric oxide, which are expunged from the mixture. The exothermal reaction of the cellulose nitrate raises the temperature of the coil to approximately 700 degrees Celsius. The barium peroxide reacts exothermally, causing the barium peroxide to decompose into barium oxide and to simultaneously release its excess oxygen before the coating mass eventually begins to solidify. Menelly teaches minimizing any oxidation of the coil substrate by flushing away the oxides by the argon stream.

In both of the aforementioned patents, oxidation produced after the coil has been coated relies on the oxygen released during coil activation.

One method of increasing the life of a fluorescent glow lamp is described in copending U.S. Ser. No. 139,397 which was filed on Dec. 30, 1987 and which is assigned to the same Assignee as the present Application. This method involves the use of a DC mode of operation coupled with the use of a anode devoid of emissive material.

Although the above-described methods may increase the life of a fluorescent lamp to some degree, it is desirable to have more improved alternative methods.

BRIEF SUMMARY OF THE INVENTION

It is, therefore, an object of the present invention to obviate the disadvantages of the prior art.

It is still another object of the invention to Provide an improved method of increasing the life of a fluorescent lamp.

It is still another object of the invention to provide an increase in lamp life without increasing the amount of emissive material applied to the cathode.

To accomplish the foregoing and other objects, features, and advantages of the invention, there is provided a method of treating a tungsten cathode that is comprised of preparing a triple carbonate suspension and then coating the surface of the tungsten cathode with the triple carbonate suspension. The coated tungsten cathode is placed in a heated oxidizing environment and then heated in the oxidizing environment to a predetermined temperature for a preset period of time to form a diffuse coating of triple carbonates and tungsten oxide. Thereafter, the triple carbonates are reduced to their respective oxides by passing heater current through the cathode.

In accordance with further teachings of the present invention, there is provided a method of manufacturing an arc discharge lamp that is comprised of preparing a triple carbonate suspension and coating the surface of the tungsten cathode with the triple carbonate suspension. The coated tungsten cathode is placed in a heated oxidizing environment and while in the heated oxidizing environment is heated to a predetermined temperature for a preset period of time to form a diffuse coating of triple carbonates and tungsten oxide. The cathode with the diffuse coating of triple carbonates and tungsten oxide is sealed within a phosphor-coated envelope. The triple carbonates on the cathode are reduced to their respective oxides by passing heater current through the cathode. The envelope is evacuated, filled with a gas fill material and hermetically sealed.

In accordance with further features of the present invention, the triple carbonate suspension includes suspension includes 48 percent by weight of $BaCO_3$, 42.5 percent by weight $SrCO_3$, 9.5 percent by weight of $CaCO_3$, and 5 percent by weight of the total triple carbonate of $ZrO_2$. Heating of the coated tungsten cathode may be performed in a tube furnace containing the heated oxidizing environment. The coated tungsten cathode is heated to a temperature within the range of from about 400 degrees Celsius to about 450 degrees Celsius. Preferably, the heating period is within the range of from about 2 minutes to about 15 minutes.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
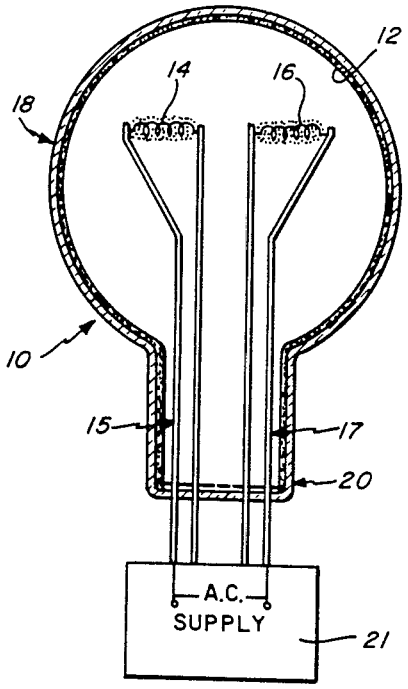
FIG. 1 is a side elevation cross-sectional view of a typical negative glow discharge lamp wherein both cathodes are treated in accordance with the principles of the present invention.

Referring now to the drawings with greater particularity to FIG. 1, there is illustrated a typical glow lamp including an envelope 10 that is provided with a phosphor coating as illustrated at 12. A pair of electrodes 14 and 16 are located in the most bulbous region 18 of the envelope and are disposed in a parallel position, typically 1–3 centimeters apart. These electrodes are supported by respective lead-in wires 15 and 17.

In FIG. 1, the envelope 10 is generally of spherical shape having a generally maximum cross-section bulbous region 18 and also including a neck region 20. The lead-in wires 15 and 17 are typically hermetically sealed at the neck region 20 with a wafer stem assembly. In FIG. 1, the electrodes 14 and 16 are approximately at the maximum cross-section bulbous region 18.

In operation, the cathode emits electrons that are accelerated so that mercury vapor is excited in the extended region of the low pressure gas. In this connection the envelope may be filled with a conventional fill material including mercury and a noble gas or mixtures of noble gases. A suitable noble gas is neon or a mixture of neon and argon.

In the lamp of FIG. 1, the two electrodes are both coated with an emissive coating that may be comprised of a mixture of barium, strontium and calcium carbonates that are converted to their respective oxides during lamp processing. The filament electrodes are both coated because the lamp is normally driven by an alternating power source so that each electrode has to act alternately, in time, as a cathode and anode, respectfully.

Figure 2:
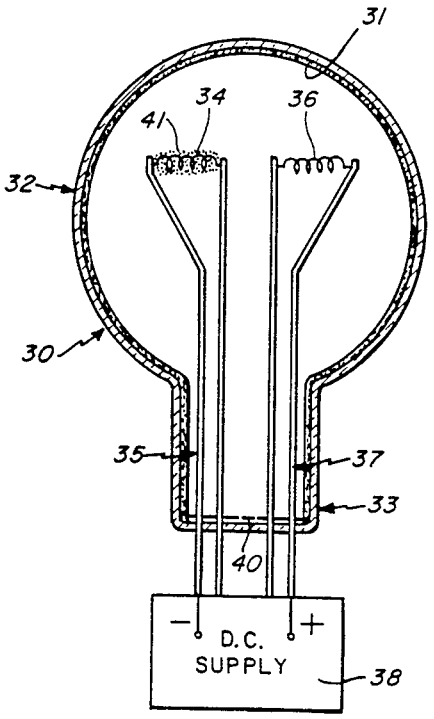
FIG. 2 is a side elevation cross-sectional view of another embodiment of a negative glow discharge lamp wherein a single cathode is treated in accordance with the principles of the present invention.

In FIG. 2, an emissive material is disposed on only one of the pair of electrodes while the other electrode of the pair of electrodes is maintained as a bare electrode. More Particularly, the coated electrode is the electrode 34 in FIG. 2 and this electrode serves as the lamp cathode 41. The other electrode 36 or anode is left free of any emissive material and is thus referred to herein as a bare tungsten electrode. The lamp in FIG. 2 is operated in a DC mode of operation rather than an AC mode of operation. As described in copending application Ser. No. 139,397 filed Dec. 30, 1987, the combination of the DC mode of operation coupled with the use of a bare anode electrode has been found to provide an improved lamp operation and in particular an improved lumen maintenance and longer life, particularly in comparison to prior art constructions.

The lamp in FIG. 2 is comprised of a lamp envelope 30 that has a bulbous region 32 and a neck region 33. Within the envelope 30 there are provided electrodes 34 and 36. Lead-in wires 35 support the electrode 34 and lead-in wires 37 support the electrode 36. A phosphor is disposed on the inner surface of the envelope as indicated at 31 in FIG. 2.

The lamp may employ an A-23 incandescent lamp envelope internally coated with a phosphor blend. The electrode mount assembly may be comprised of a multipin wafer stem 40 with the attached lead-in wires 35 and 37 made of 0.020 inch diameter nickel. The electrodes 34 and 36 are clamped on the ends of each pair of lead-in wires. Each of the electrodes may be a #41 triple coiled tungsten exciter.

Figure 3:
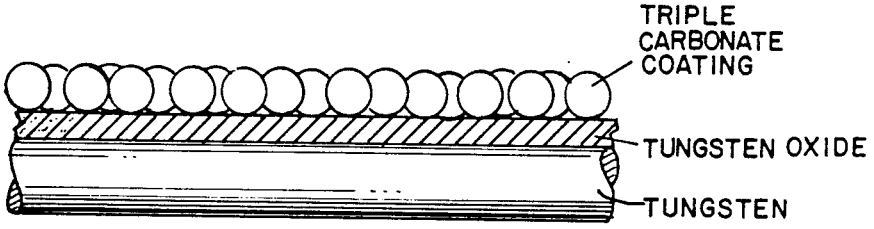
PRIOR ART FIG. 3
FIG. 3 is an illustration of the surface of a cathode prior to activation treated in accordance with the principles of the prior art.
Figure 4:
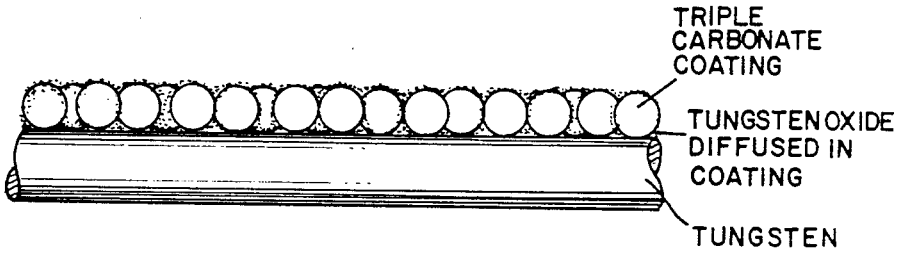
FIG. 4 is an illustration of the surface of a cathode prior to activation treated in accordance with the principles of the present invention.
Figure 5:
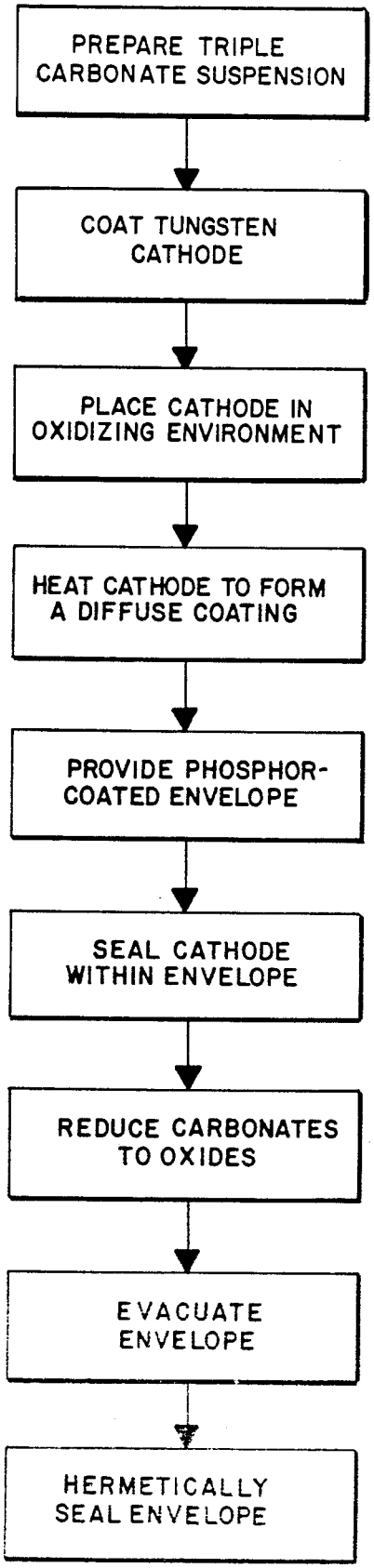
FIG. 5 is an flow chart illustrating a process of manufacturing a fluorescent lamp in accordance with the principles of the present invention.

Now, in accordance with the teachings of the present invention and with reference to FIG. 3, electrodes 14, 16 in FIG. 1 and 34 in FIG. 2 are treated by first coating the tungsten electrodes or cathodes with a triple carbonate suspension. The triple carbonate suspension is prepared in the conventional manner and may be a standard mixture which includes barium, strontium and calcium in a solution of nitrocellulose in amyl acetate. Preferably, the suspension includes 48 percent by weight of $BaCO_3$, 42.5 percent by weight $SrCO_3$, 9.5 percent by weight of $CaCO_3$, and 5 percent by weight of the total triple carbonate of $ZrO_2$. For a #41 triple coiled tungsten exciter, the coating weight per exciter is approximately 28 milligrams. The coated electrodes are placed in a heated oxidizing environment (e.g., air, oxygen, $CO_2$), such as in a tube furnace wherein the electrodes are heated sufficiently to form a diffuse coating of triple carbonates and tungsten oxide as illustrated in FIG. 4. It should be noted that in this pre-oxidation stage, the electrodes are heated by the oxidizing environment itself and not, for example, by the passage of current through the electrodes. The coil temperature gradient exhibited when current is passed through a tungsten coil prevents uniform heating. For example, delivering 2.0 amperes through a #41 exciter, causes the two center turns to operate at about 450 degrees Celsius (plus or minus 20 degrees Celsius) while the two outer turns operate at about 325 degrees Celsius (plus or minus 20 degrees Celsius). The outer turns of the coil run cooler as the result of radiational cooling.

By diffuse coating is meant a coating wherein the tungsten oxide layer formed in the pre-oxidation operation described above, is scattered or mixed with triple-carbonate cathode coating prior to activation of the cathode. This diffuse coating is in contrast to the teachings of the Homer et al patent wherein two distinct layers are formed on the tungsten substrate. In the Homer et al patent as illustrated in FIG. 3, a distinct monomolecular layer of tungsten oxide appears at the interface between the tungsten substrate and the alkaline earth oxide.

The lumen maintenance and operating life of the glow lamp are greatly effected by evaporation of the emissive material followed by condensation on the envelope walls The pre-oxidation treatment of the tungsten coil with carbonate coating disposed thereon has been found to be a more efficient means of preventing barium evaporation from the lamp cathode. Although not fully understood, it is believed that a stable chemical interaction is created between the tungsten oxide and carbonate coating. The formation of this diffuse coating of carbonates and tungsten oxide enhances the chances of forming barium tungstate during the cathode activation process. In the Homer et al patent, the oxide formed on the tungsten substrate is more likely to be reduced prior to the interaction with the emissive coating during vacuum exhausting of the lamp.

In connection with the barium ionization, it is noted that barium oxide has a higher vapor pressure than either the strontium or calcium oxides so that reference has been made primarily only to barium. However, there are small amounts of strontium and calcium that are evaporated. These are ionized and are driven toward or away from the electrodes substantially as described in connection with the ionized barium.

The diffuse coating of the present invention can be produced by heating the electrode in the aforementioned oxidizing environment at a temperature within the range of from about 400 degrees Celsius to about 450 degrees Celsius. Generally, the amount of time is between about 2 minutes to about 15 minutes. The temperature and duration is dependent on factors such as coil type and emissive coating composition. The temperature during this pre-heating Process is insufficient to reduce the carbonates to their respective oxides or to form barium tungstate.

In constructing a lamp in accordance with the teachings of the present invention, the cathode having the diffuse coating applied in the manner described above, is sealed within a Phosphor-coated envelope (FIG. 3). The envelope is evacuated of air and heated to approximately 400 degrees Celsius. The cathode is activated in a vacuum to reduce the carbonates to their respective oxides by heating to approximately 1,250 degrees Celsius by passage of current therethrough. The lamp envelope is evacuated and backfilled with a 3 torr mixture of neon and argon. This mixture may comprise 99.5% neon and 0.5% argon along with a drop of mercury, approximately 30 milligrams in weight. The envelope is finally hermetically sealed by tipping off.

Lamps similar to that shown in FIG. 2, made in accordance with the teachings of the present invention, were compared to lamps made according to the teachings of the Homer et al patent. The monomolecular oxide layer taught by the Homer patent was produced by coating an oxidation-free tungsten cathode with the triple-carbonate suspension and then allowing the carbon dioxide produced during breakdown of the carbonates to oxidize the tungsten cathode. The cathodes in both test and control lamps were coated with approximately 28 milligrams of carbonate material. Both test and control lamps were burned continuously and periodically measured for lamp voltage. The data in TABLE I below illustrate lamp voltage as a function of aging time.

TABLE I

| | LAMP VOLTAGE | |
|---|---|---|
| AGING TIME | PRESENT INVENTION | PRIOR ART |
| 0 | 14.3 | 14.4 |
| 100 | 12.2 | 13.3 |
| 360 | 13.0 | 12.3 |
| 864 | 13.2 | 13.4 |
| 1776 | 12.2 | 12.2 |
| 2880 | 12.9 | 13.4 |
| 3888 | 14.0 | 14.6 |
| 8300 | 13.0 | 15.6 |

As illustrated in TABLE I, the voltages of lamps of the prior art steadily increased beginning after 1776 hours of burning. After 8300 hours, the lamp voltage of the prior art lamp was 2.6 volts higher than the lamp of the present invention. This higher voltage adversely affects lamp life due to more intense ion bombardment. The effect of more severe ion bombardment is evidenced by the fact that after 10,000 hours of burning more emissive material (approximately two times more) remains on the cathode treated in accordance with the teachings of the present invention. A decrease in the amount of spotting on the phosphor was also observed on test lamps.

There has thus been shown and described an improved method of treating tungsten cathodes which results in an increase in the life of a fluorescent lamp. The improvement is accomplished without increasing the amount of emissive material applied to the cathode.

While there have been shown and described what are at present considered to be the preferred embodiments of the invention, it will be apparent to those skilled in the art that various changes and modifications can be made herein without departing from the scope of the invention. For example, the invention is not limited to single-ended glow lamps but is also applicable to conventional double-ended fluorescent lamps having elongated envelopes and longer arc lengths. The embodiments shown in the drawings and described in the specification are intended to best explain the principles of the invention and its practical application to hereby enable others in the art to best utilize the invention in various embodiments and with various modifications as are suited to the particular use contemplated.

What is claimed is:

1. A method of treating a tungsten cathode comprising the steps of:

preparing a triple carbonate suspension;

coating the surface of said tungsten cathode with said triple carbonate suspension;

placing said coated tungsten cathode in a heated oxidizing environment;

heating said coated tungsten cathode in said heated oxidizing environment to a predetermined temperature for a preset period of time to form a diffuse coating of triple carbonates and tungsten oxide; and reducing said triple carbonates to their respective oxides by passing heater current through said cathode.

2. The method of treating a tungsten cathode of claim 1 wherein said method includes the step of providing a triple carbonate suspension comprising barium, strontium and calcium.

3. The method of treating a tungsten cathode of claim 2 wherein said method includes the step of providing a triple carbonate suspension including 48 percent by weight of $BaCO_3$, 42.5 percent by weight $SrCO_3$, 9.5 percent by weight of $CaCO_3$, and 5 percent by weight of the total triple carbonate of $ZrO_2$.

4. The method of treating a tungsten cathode of claim 1 wherein the method includes the steps of providing a tube furnace enclosing said heated oxidizing environment and heating said coated tungsten cathode in said heated oxidizing environment enclosed within said tube furnace to a predetermined temperature for preset period of time to form said diffuse coating of triple carbonates and tungsten oxide.

5. The method of treating a tungsten cathode of claim 1 wherein said predetermined temperature is within the range of from about 400 degrees Celsius to about 450 degrees Celsius.

6. The method of treating a tungsten cathode of claim 5 wherein said predetermined temperature is about 450 degrees Celsius.

7. The method of treating a tungsten cathode of claim 1 wherein said preset amount of time is within the range of from about 2 minutes to about 15 minutes.

8. The method of treating a tungsten cathode of claim 7 wherein said preset amount of time is about 2 minutes.

9. The method of treating a tungsten cathode of claim 1 wherein said heated oxidizing environment includes air.

10. The method of treating a tungsten cathode of claim 1 wherein said heated oxidizing environment includes oxygen or carbon dioxide.

11. A method of manufacturing an arc discharge lamp comprising the steps of:

preparing a triple carbonate suspension;

coating the surface of said tungsten cathode with said triple carbonate suspension;

placing said coated tungsten cathode in a heated oxidizing environment;

heating said coated tungsten cathode in said heated oxidizing environment to a predetermined temperature for a preset period of time to form a diffuse coating of triple carbonates and tungsten oxide;

providing a phosphor-coated envelope;

sealing said cathode with said diffuse coating of triple carbonates and tungsten oxide within said envelope;

reducing said triple carbonates on said cathode to their respective oxides by passing heater current through said cathode;

evacuating said envelope; and hermetically sealing a gas fill material within said envelope.

12. The method of treating a tungsten cathode of claim 11 wherein said method includes the step of providing a triple carbonate suspension including barium, strontium and calcium.

13. The method of treating a tungsten cathode of claim 11 wherein said method includes the step of providing a triple carbonate suspension including 48 percent by weight of $BaCO_3$, 42.5 percent by weight $SrCO_3$, 9.5 percent by weight of $CaCO_3$, and 5 percent by weight of the total triple carbonate of $ZrO_2$.

14. The method of treating a tungsten cathode of claim 11 wherein said method includes the steps of providing a tube furnace enclosing a heated oxidizing environment and heating said coated tungsten cathode in said heated oxidizing environment enclosed within said tube furnace to a predetermined temperature for a preset period of time to form a diffuse coating of triple carbonates and tungsten oxide.

15. The method of treating a tungsten cathode of claim 11 wherein said predetermined temperature is within the range of from about 400 degrees Celsius to about 450 degrees Celsius.

16. The method of treating a tungsten cathode of claim 15 wherein said predetermined temperature is about 450 degrees Celsius.

17. The method of treating a tungsten cathode of claim 11 wherein said preset amount of time is within the range of from about 2 minutes to about 15 minutes.

18. The method of treating a tungsten cathode of claim 17 wherein said preset amount of time is about 2 minutes.

19. The method of treating a tungsten cathode of claim 11 wherein said heated oxidizing environment includes air.

20. The method of treating a tungsten cathode of claim 11 wherein said heated oxidizing environment includes oxygen or carbon dioxide.

* * * * *